United States Patent [19]

Ford

[11] Patent Number: 4,857,798

[45] Date of Patent: Aug. 15, 1989

[54] FLUORESCENT LAMP WITH SILICA LAYER

[75] Inventor: Cheryl A. Ford, Byfield, Mass.

[73] Assignee: GTE Products Corporation, Danvers, Mass.

[21] Appl. No.: 62,259

[22] Filed: Jun. 12, 1987

[51] Int. Cl.[4] ..... H01J 61/44; H01J 61/35

[52] U.S. Cl. ..... 313/487; 313/489

[58] Field of Search ..... 313/489, 487, 488

[56] References Cited

U.S. PATENT DOCUMENTS 3,937,998 2/1976 Verstegen et al. ..... 313/487

4,344,016 8/1982 Hoffmann et al. ..... 313/489

FOREIGN PATENT DOCUMENTS 0065440 4/1985 Japan ..... 313/489

*Primary Examiner*—Palmer C. DeMeo

*Attorney, Agent, or Firm*—Martha Ann Finnegan

[57] ABSTRACT

A fluorescent lamp having a CRI approximately the same as the CRI of the lamp phosphor is disclosed. The method includes applying a coating comprising fine particle-size silica to the inner surface of the lamp envelope to form a coated envelope, the coating having a coating weight greater than 0.7 milligrams per square centimeter and less than the weight at which lumen output of the lamp is reduced due to absorption of visible wavelength light by the silica. A coating of phosphor selected to provide a predetermined CRI is applied over the silica layer; and the coated phosphor envelope is processed into a finished lamp. A fluorescent lamp having a CRI approximately equal to the CRI of the lamp phosphor is also disclosed. The lamp of the present invention includes a lamp envelope having an inner surface; a layer of fine particle-size silica disposed on the inner surface of the lamp envelope, the silica layer containing greater than about 0.7 mg/cm$^2$ of fine particle-size silica; and a coating of phosphor selected to provide a predetermined CRI disposed over the silica layer, the fluorescent lamp having a CRI approximately the same as the CRI of the phosphor.

5 Claims, 2 Drawing Sheets

FLUORESCENT LAMP WITH SILICA LAYER

BACKGROUND OF THE INVENTION

The present invention relates to lamps and more particularly to lamps including a phosphor layer and a non-phosphor layer.

Various coatings of non-luminescent particulate materials have been found to be useful when applied as an undercoating for the phosphor layer in mercury vapor discharge lamps, including fluorescent lamps. The phosphor coating is disposed on the inner surface of the lamp glass envelope in receptive proximity to the ultraviolet radiation being generated by the mercury discharge.

Examples of non-luminescent particulate materials which have been used in fluorescent lamps such as, for example, aperture fluorescent reprographic lamps, include titanium dioxide, mixtures of titanium dioxide and up to 15 weight percent aluminum oxide, aluminum, and silver. Titanium dioxide is typically used in commercially available aperture fluorescent reprographic lamps.

In some instances a layer of a non-luminescent particulate material is used to permit reduction in the phosphor coating weight. See, for example, U.S. Pat. No. 4,079,288 to Maloney et al., issued on Mar. 14, 1978. U.S. Pat. No. 4,074,288 discloses employing a reflector layer comprising vapor-formed spherical alumina particles having an individual particle size range from about 400 to 5000 Angstroms in diameter in fluorescent lamps to enable reduction in phosphor coating weight with minor lumen loss. The lamp data set forth in the patent, however, shows an appreciable drop in lumen output at 100 hours.

U.S. Pat. No. 4,344,016 to Hoffman et al., issued on Aug. 10, 1982 discloses a low pressure mercury vapor discharge lamp having an $SiO_2$ coating having a thickness of 0.05 to 0.7 mg/cm$^2$. U.S. Pat. No. 4,344,016 expressly provides that the use of thicker coatings causes a reduction in the luminous efficacy due to the occurrence of an absorption of the visible light.

Other attempts to improve the performance of and/or to reduce the costs associated with the manufacture of mercury vapor discharge lamps have involved the use of more than one phosphor layer. While the inclusion of an additional phosphor layer may achieve the desired maintenance improvement or cost reduction, the use of an additional phosphor coating is typically accompanied by a decrease in Color Rendering Index (CRI) of the lamp including the additional layer of phosphor.

SUMMARY OF THE INVENTION

In accordance with the present invention there is provided a method for making a fluorescent lamp including a phosphor, the lamp having a CRI approximately the same as the CRI of the phosphor, the method comprising applying a coating comprising fine particle-size silica at a coating weight greater than 0.7 milligrams per square centimeter to the inner surface of the lamp envelope to form a silica coated envelope; applying a coating of phosphor selected to provide a predetermined CRI over the silica layer; and processing the phosphor coated envelope into a finished lamp.

In accordance with another aspect of the present invention there is provided a method for making a fluorescent lamp including a phosphor, the lamp having a CRI approximately the same as the CRI of the phosphor, the method comprising applying a coating suspension comprising fine particle-size silica, water, a negative charge precursor, a defoaming agent, a surface active agent, an insolubilizing agent, a plasticizer, and two water-soluble binders to the inner surface of a lamp envelope to form a coated envelope; heating the coated envelope to cure the coating and remove the water from the coating; applying a phosphor suspension including a phosphor selected to provide a predetermined CRI over the cured silica layer; and processing the phosphor coated envelope into a finished lamp.

In accordance with another aspect of the present invention, there is provided a fluorescent lamp comprising a lamp envelope having an inner surface; a layer of fine particle-size silica disposed on the inner surface of the lamp envelope, the layer containing greater than about 0.7 mg/cm$^2$ of fine particle-size silica; and a phosphor coating disposed over the silica layer, the phosphor coating comprising a phosphor selected to provide a predetermined CRI, the fluorescent lamp having a CRI approximately the same as the CRI of the phosphor.

Figure 1:
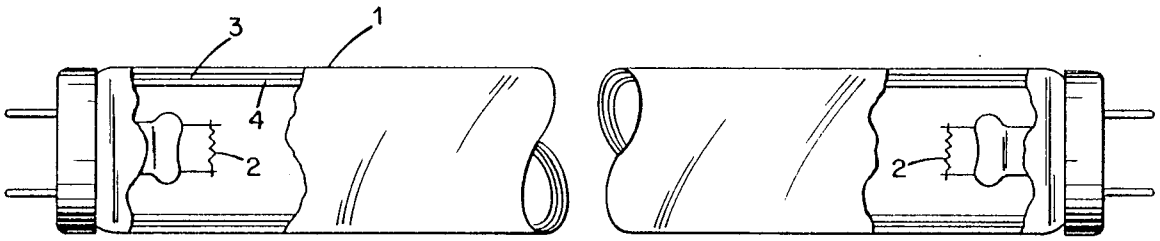
FIG. 1 is an elevational view of a fluorescent lamp, in partial cross-section, in accordance with the present invention.

For a better understanding of the present invention, together with other and further objects, advantages, and capabilities thereof, reference is made to the following disclosure and appended claims in connection with the above-described drawings.

DETAILED DESCRIPTION

The present invention is directed to a fluorescent lamp including a phosphor, the lamp having a CRI approximately the same as the CRI of the phosphor, and a method for making a fluorescent lamp.

The fluorescent lamp of the present invention includes a lamp envelope having an inner surface. A layer of fine particle-size silica is disposed on at least a portion of the inner surface of the lamp envelope at a coating weight greater than about 0.7 mgcm$^2$ and a phosphor coating is disposed over the silica layer. The phosphor coating may further be disposed on any portion of the inner surface of the envelope not coated with the fine particle-size silica layer.

In accordance with a preferred embodiment of the present invention it has been found that the Color Rendering Index (CRI) of fluorescent lamps having at least two phosphor layers, one of the phosphor layers being a less expensive phosphor layer used to permit a reduction in the weight of a more expensive phosphor, can be improved by including a layer comprising fine particle-size silica (also referred to herein as silicon dioxide) in the lamp while eliminating the less expensive phosphor layer. Most preferably the silica layer is interposed between the lamp envelope and the phosphor coating whereby no portion of the silica layer is exposed to or in contact with mercury in the lamp. Silica has an affinity for mercury and therefore will absorb mercury upon exposure thereto or contact therewith. The depletion of mercury in the lamp due to absorption of mercury by the silica layer can result in lamp maintenance loss.

The use of the fine particle-size silica layer under the phosphor coating advantageously improves the performance of the phosphor in the lamp while causing negligible, if any, reduction in CRI of the desired phosphor. In other words, the CRI of a lamp including a fine particle-size silica layer and a coating of phosphor selected to provide a predetermined CRI is approximately the same as the CRI of a lamp including a coating of the same phosphor without the silica layer. The use of the silica layer further provides a lamp with a desired lumen output and CRI approximately equal to the CRI of the desired phosphor while using less phosphor than would be required to get the same lumen output if the desired phosphor were used alone.

The present invention is particularly advantageous when used in a fluorescent lamp which includes a triphosphor layer. Fluorescent lamps containing a triphosphor layer often include a layer of a less expensive phosphor, for example, a halophosphate phosphor, interposed between the envelope and the triphosphor layer. The halophosphate layer is used to provide the desired lumen output for the lamp while permitting a reduction in the weight amount of the expensive triphosphor phosphor in the lamps. The inclusion of halophosphate layer does, however, result in a lower CRI for the lamp than if the triphosphor were used alone.

When a layer of fine particle-size silica is substituted for the halophosphate phosphor in the above-described lamp, the lamp provides the desired lumen output with a reduced triphosphor weight without a reduction in CRI.

For example, an F40 fluorescent lamp including a single layer of a triphosphor blend (with red phosphor Type No. 2342 obtained from the Chemical and Metallurgical Division of GTE Products Corporation, Towanda, Pa.) requires a phosphor coating weight of about 5 grams (3.75 mg/cm$^2$) to obtain a lamp with a commercially acceptable lumen output. A lamp in accordance with the present invention employing from about 1.7 to about 3.5 mg/cm$^2$ fine particle-size $SiO_2$ provides a comparable lumen output with approximately half as much of the same triphosphor blend.

The silicon dioxide particles used to form the silica layer, or coating, are high purity silicon dioxide, i.e., the silicon dioxide particles used comprise at least 99.0% by weight $SiO_2$. Preferably, the silicon dioxide particles comprise greater than or equal to 99.8 by weight $SiO_2$. The weight percent silicon dioxide represents the degree of purity of the silicon oxide used.

The coating weight for the silicon dioxide layer is greater than 0.7 mg/cm$^2$ and less than the weight at which the lumen output of the lamp is reduced due to absorption of the visible light by the silicon dioxide layer. For example, a silicon dioxide layer coating weight of from about 0.7 to about 4 milligrams/square centimeter is acceptable. Preferably, the coating weight of the silicon dioxide reflecting layer is from about 1.7 to about 3.5; and most preferably about 2.2 milligrams/-square centimeter.

As used herein, "fine particle-size silica" or "fine particle-size silicon dioxide" refers to silica or silicon dioxide wherein at least about 80 weight percent of the silicon dioxide particles have a primary particle size from about 5 to about 100 nanometers. Preferably, at least about 80 weight of the silica particles has a primary particle size from about 5 to about 100 nm and at least about 50 weight percent of those particles has a primary particle size from about 17 to about 80 nm. Most preferably, the primary particle size distribution peaks at about 40–50 nm.

A fluorescent lamp in accordance with the present invention includes an envelope having a pair of electrodes sealed therein; a fill including an inert gas at a low pressure and a small quantity of mercury, a fine particle-size silica coating deposited on at least a portion of the inner surface of the lamp envelope; and a phosphor coating deposited over said silica layer. The phosphor may further be disposed on any uncoated portion of the inner surface of the lamp envelope. The phosphor coating may include more than one phosphor layer.

The fluorescent lamp of the present invention may optionally include additional non-phosphor coatings for various other purposes.

Referring to FIG. 1, there is shown an example of a fluorescent lamp in accordance with the present invention. The fluorescent lamp shown in FIG. 1 comprises an elongated glass, e.g., soda lime silica glass, envelope 1 of circular cross-section. It has the usual electrodes 2 at each end of the envelope 1 supported on lead-in wires. The sealed envelope, or tube, is filled with an inert gas, such as argon or a mixture of inert gases, such as argon and neon, at a low pressure, for example 2 torr; and a small quantity of mercury is added, at least enough to provide a low vapor pressure of, for example, about six (6) microns during operation.

The inner surface of the tubular glass envelope is first coated with a fine particle-size silicon dioxide coating 3. A layer 4 of the desired phosphor is coated over the silicon dioxide coating.

In a preferred embodiment of the present invention the phosphor is a triphosphor blend. A triphosphor blend comprises a first luminescent material having an emission band with a maximum between 430 and 490 nm; a second luminescent material having its emission in the range of 520–565 nm; and a third luminescent material having its emission in the range 590–630 nm. Such blends are white-emitting and typically have color temperatures from about 2700 to about 4500K. The relative amounts of the components in the triphosphor blend is a function of the specific identify of the components used and the color desired. Such determinations are easily made by one of ordinary skill in the art.

As described above, the present invention permits use of a phosphor coating having a weight less than that required to obtain an approximately equal lumen output in a fluorescent lamp including said phosphor coating and no silica layer with negligible, if any, CRI loss. This permits use of a triphosphor layer having a coating weight less than 3.75 mg/cm$^2$. A preferred coating weight for the triphosphor blend is greater than or equal to 0.35 mg/cm$^2$ and less than 3.75 mg/cm$^2$.

As used herein, "fluorescent lamp" refers to any discharge device including a phosphor excited to fluorescence by ultra-violet radiation, regardless of configuration.

A phosphor comprises any material excited to fluorescence by ultraviolet radiation.

While the silicon oxide layer of the present invention can be applied to the envelope by fully coating the lamp surface with an organic base-suspension of the above-described silicon dioxide particles, the use of an organic-base suspension may produce poor texture coatings caused, for example, by flaking away of the coating. Flaking is more frequently experienced when applying thicker coatings, e.g., over 2.5 mg/cm$^2$, from organic-base suspensions.

Advantageously, such flaking is eliminated when the fine particle-size silica layer is applied to the envelope by fully coating the lamp surface with a water-base suspension of the above-described silicon dioxide particles. In addition to the fine particle-size silica, the water-base coating suspension further includes a negative charge precursor, two water-soluble binders, a defoaming agent, a surface active agent, an insolubilizing agent, and a film-plasticizing agent. The coating suspension is applied to the inner surface of the envelope and the coated envelope is then heated at a temperature and for a period of time sufficient to remove the water from the coating and to cure the coating. The phosphor coating is applied thereover by conventional lamp processing techniques.

Advantageously, the cured silica layer is insoluble when contacted with an aqueous medium. This feature of the silica coating eliminates the need for a bake-out step prior to applying the phosphor coating suspension to the silica-coated envelope.

More particularly, the fine particle-size silica coating suspension is prepared by mixing a fine particle-size silica, such as Aerosil® OX-50 manufactured by DeGussa, Inc., with a mixture of deionized water, a negative charge precursor, for example, an aqueous base such as ammonium hydroxide, a defoaming agent, a surface active agent, an insolubilizing agent, and a plasticizer to form a slurry. Two water soluble binders are also added to the slurry. Preferably the two water soluble binders are added to the slurry in solution form.

A preferred pair of water soluble binders for use in the present invention are a first binder comprising hydroxyethylcellulose and a second binder comprising poly(ethylene oxide). When this preferred pair of binders is used, the hydroxyethylcellulose concentration is selected such that the cured film applied to the envelope is not soluble in the phosphor coating suspension applied thereover during the phosphor coating step. Preferably, the concentration of hydroxyethylcellulose in the coating suspension is at least 1 weight percent based on the weight of the silica. Most preferably, the concentration is from about 1 to about 1.2 weight percent based on the weight of the silica. At higher concentrations, the solution can become too viscous requiring additional water to be added, thereby lowering the amount of fine particle-size silica which can be deposited on the inner surface of the lamp envelope.

The use of a single binder, such as hydroxyethylcellulose, in a water-base coating suspension, does not provide uniform distribution of silica on the inner surface of the lamp envelope. An acceptable film texture is characterized by tightly packed silica particles uniformly distributed on the inner surface of the lamp envelope so as to provide a smooth uninterrupted film.

Advantageously, the further inclusion of a second water-soluble binder, such as, of poly (ethylene oxide) solution produces an acceptable film texture. The concentration of the second water-soluble binder in the coating suspension is selected to produce a smooth film texture. For example, the inclusion of poly (ethylene oxide) in the suspension in an amount of at least 8.8% based on the weight of the fine particle-size silica produces an acceptable film texture. A coating suspension containing 8.8% poly (ethylene oxide) based on the weight of fine particle-size silica deposits a layer containing about 3.0 g fine particle-size silica layer on the inside of a 40T12 fluorescent tube (approximate surface area of about 1335 cm$^2$). Thinner films of silica are obtained by diluting the silica coating suspension with additional amounts of a poly (ethylene oxide) solution with no effect on insolubility as long as 1.0% hydroxyethylcellulose based on the silica weight is present in the coating suspension.

The weight ratio of the insolubilizing agent to the first binder in the coating suspension is at least 0.5. Preferably, the ratio is in the range of 0.5–1.0. At ratios below 0.5, the coating film does not attain film insolubility, i.e., the resultant film at least partially dissolves in the coating suspension when the phosphor is applied thereover. The insolubilizing agent is a material which effects cross-linking of the binders during a low-temperature (e.g., below 300° C.) heating step which renders the silica coating insoluble. An example of a preferred insolubilizing agent is dimethylolurea.

The plasticizer concentration, based on the weight of the silica, is preferably about 2 to about 3% by weight. Below 2% by weight, pin holing can occur after the application of the phosphor coat; and above 3% by weight, coating defects, particularly mottling, can occur. An example of a preferred plasticizer is glycerine.

The concentration of the negative charge precursor is preferably greater than or equal to about 0.05 moles per 100 grams (g) fine particle-size silica and most preferably greater than or equal to about 0.05 to about 0.091 moles per 100 g of the silica. The introduction of negative ions reduces the thickening properties of the negatively charged fine particle-size silica. In amounts below 0.05 moles per 100 g silica, the coating suspension may be too viscous to coat bulbs. In amounts in excess of 0.091 moles per 100 g silica, the negative charge precursor provides little additional lowering of the viscosity of the suspension. For example, when an aqueous base such as $NH_4OH$ is used as the negative charge precursor in an amount of about 0.05 to about 0.091 moles of $NH_4OH$ per 100g silica, the viscosity of the fine particle size-silica coating suspension was lowered from 35–40″ viscosity (viscosity without the ammonium hydroxide) to 16–20″ viscosity (with ammonium hydroxide) measured by the Sylvania Cup.

The viscosity number given herein was measured as the number of seconds required to empty a special cup, referred to herein as the Sylvania Cup, filled with the material being measured, and having a one-eighth inch diameter hole at the center of its bottom, through which the material may flow. The cup is made from a nickel crucible having an inside diameter, at its top, of 1.5 inches. Such a crucible has a flat bottom, which has been rounded out for the present purpose so that the overall inside length from the top of the cup to the bottom is 1½ inches. The cup holds 33 cc of liquid when filled to the top.

The defoaming agent and surfactant (also referred to herein as a "surface active agent") can be any such materials conventionally employed in lamp coating technology. Such materials are well known in the art.

Preferably at least about 0.01% defoaming agent based upon the volume of the coating suspension is used and most preferably from about 0.025% to about 0.04%. The concentration of the surfactant in the coating suspension is preferably at least about 0.001% based upon the volume of suspension and most preferably from about 0.0025% to about 0.004%.

The concentration of the fine particle-size silica in the coating suspension is preferably no more than about 150 g/l and most preferably from about 40 g/l to about 132 g/l. At concentrations less than 40 g/l an insufficient amount of silica may be deposited in the lamp; and at concentrations above 150 g/l non uniform films may occur.

The following is exemplary of the making of a lamp in accordance with the present invention and is not to be construed as necessarily limiting thereof.

EXAMPLE

A coating suspension in accordance with the present invention was prepared from the following components mixed together in the order as listed:

| | |
|---|---|
| 150 cc | deionized water |
| 12 cc | ammonium hydroxide Reagent Grade Assay (28–31%) |
| 0.28 cc | defoaming agent (Hercules type 831) |
| 0.028 cc | surfactant (BASF type 25R-1 Pluronic) |
| 2.5 cc | glycerine |
| 0.45 g | dimethylolurea |
| 150 g | Aerosil ® R OX-50 (obtained from DeGussa, Inc.) |
| 100 cc | hydroxyethylcellulose solution containing 1.7 weight percent of the resin (Natrosol (HEC) grade 250 MBR obtained from Hercules) in water |
| 600 cc | poly (ethylene oxide) solution containing 2.2 weight percent of the resin (WSRN 2000 obtained from Union Carbide) in water |

An insoluble fine particle-size silica layer was applied by causing the above-formulated coating suspension to flow down the inner wall of a tubular fluorescent lamp envelope being held in a vertical position.

After allowing the bulb to drain for 30 seconds, the coated tubes were placed in an air drying chamber maintained at a temperature of 230° F. for 30 minutes to remove the water and complete the cross linking reaction between the two water-soluble binders (also referred to herein as resins) and the cross-linking reactant, dimethylolurea.

The preceding Example formulation allowed about 2.5–3.0 grams of Aerosil ® OX-50 to be deposited on the inner surface of a standard 40 watt T12 fluorescent lamp envelope of circular cross-section. The dried silica coated bulb was allowed to cool to room temperature, following which the silica layer was overcoated with water-base 3K° Royal White triphosphor suspension by known techniques. The double coated bulb was baked at about 600° C. for 2 minutes to remove the organic components of the binders. The coated envelope was then processed into a fluorescent lamp by conventional lamp manufacturing techniques. The present invention advantageously eliminates the need for more than one bakeout step in lamp processing.

An initial lamp test was conducted to compare the performance of a lamp employing a double phosphor coating with a lamp in accordance with the present invention.

The initial lamp test results are tabulated in Table 1. Lamp A is a Sylvania Standard 3K° Royal White40T12 fluorescent lamp. The lamp includes two phosphor layers. The first coat applied to the envelope is a warm white halophosphate phosphor and the second coat is a 3K° triphosphor blend, the composition of which is described below. Lamp B is a 40T12 fluorescent lamp in accordance with the present invention. The first coat is a fine particle-size silica layer which was applied by a method similar to that described in the foregoing Example. The second coat is the standard 3K° triphosphor blend described below. The lamps were otherwise fabricated using conventional lamp processing techniques. The weights of the coatings, or layers, in the lamp are set forth in Table I as well as lamp performance data for 10,000 hours, the x-y color coordinates and the CRI for the lamps.

The standard 3K° blend formulation used in the initial evaluation contained:

65.0% $Y_2O_3$:Eu red phosphor
33.5% Ce, Tb Magnesium Aluminate green phosphor
1.5% Ba, Mg Aluminate:Eu blue phosphor The initial evaluation showed (at 100 hours) the 3K° Royal White lamps including the single phosphor layer with the silica layer provided a 5 unit improvement in CRI over the standard 3K° Royal White lamps. After 10,000 hours burning, the 3K° Royal White lamps including the silica layer were 1.5% brighter than the standard lamps due to the 2% superior maintenance characteristics. The color of the lamps, including the silica layers, however, were slightly redder.

The necessary color corrections were determined. The corrected 3K° blend formulation for lamps including a fine particle-size silica layer is as follows:

64.0% $Y_2O_3$:Eu red phosphor
34.0% Ce, Tb Magnesium Aluminate green phosphor
2.0% Ba, Mg Aluminate:Eu blue phosphor

TABLE 1

INITIAL TEST

| Lamp Description | 1st Coat | 2nd Coat | 1st Coat Weight (grams) | 2nd Coat Weight (grams) |
|---|---|---|---|---|
| A | Warm White Phosphor | 3K° Triphosphor | 3.1 | 2.69 |
| B | Silica | 3K° Triphosphor | 3.0 | 2.70 |

| Lamp Description | Brightness 0 Hrs | 100 Hrs | 500 Hrs | 1000 Hrs | 2000 Hrs |
|---|---|---|---|---|---|
| A | 3406 | 3343 | 3330 | 3268 | 3199 |
| B | 3394 | 3320 | 3307 | 3243 | 3171 |

| Lamp Description | Brightness 3000 Hrs | 5000 Hrs | 6000 Hrs | 8000 Hrs | 10,000 Hrs |
|---|---|---|---|---|---|
| A | 3151 | 3065 | 3053 | 2991 | 2975 |
| B | 3133 | 3105 | 3076 | 3043 | 3020 |

| Lamp Description | Color X | Y | CRI |
|---|---|---|---|
| A | .451 | .419 | 78.2 |
| B | .456 | .415 | 83.2 |

A triphosphor blend containing one percent less red phosphor, 0.5% more green phosphor, and 0.5% more blue than the standard blend is necessary to obtain the standard 3K° color for a fluorescent lamp including a layer of fine particle-size silica interposed between the lamp envelope and the phosphor layer.

A second lamp test series was also conducted to compare the results of lamps containing different weights of fine particle-size silica in the silica layer. Aerosil ®

Figure 2:
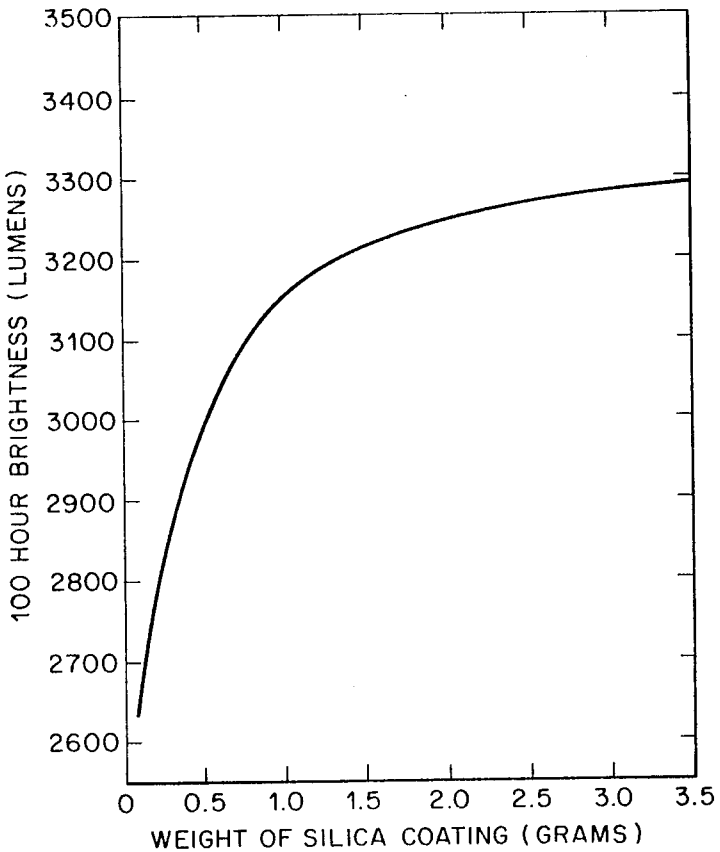
FIG. 2 graphically represents lumen output as a function of the weight of the silica coating after 100 hours of operation for an F40 lamp in accordance with the present invention which includes a phosphor coating with a weight of about 1.7 grams.

OX-50 was used as the fine particle-size silica in this test series. The weight of the fine particle-size silica layer was varied over a range from 0.98–3.38 g in 40T12 fluorescent lamps. The silica layer in each lamp was applied by a method similar to the method of the foregoing Example with the amount of poly (ethylene oxide) being increased to apply the lighter silica coating weights. Each lamp of the test series was second coated with approximately the same amount of the standard 3K° triphosphor blend formulation. The coating weights, brightness, color, and CRI results for this second lamp test series are tabulated in Table 2. A small decrease in brightness occurs as the silica layer weight decreases. A 71% reduction in silica layer weight, from 3.38 g to 0.98 g, results in a brightness loss of 4.5%. Equivalent brightness to the standard 3K° lamp is achieved at the highest silica layer weight of 3.38 g. It should be noted, however, that the CRI of all the silica containing lamps remains essentially the same, approximately 84.0, regardless of the OX-50 weight. The 100 hour lumen data for the lamps described in Table 2 is graphically represented in FIG. 2.

Figure 3:
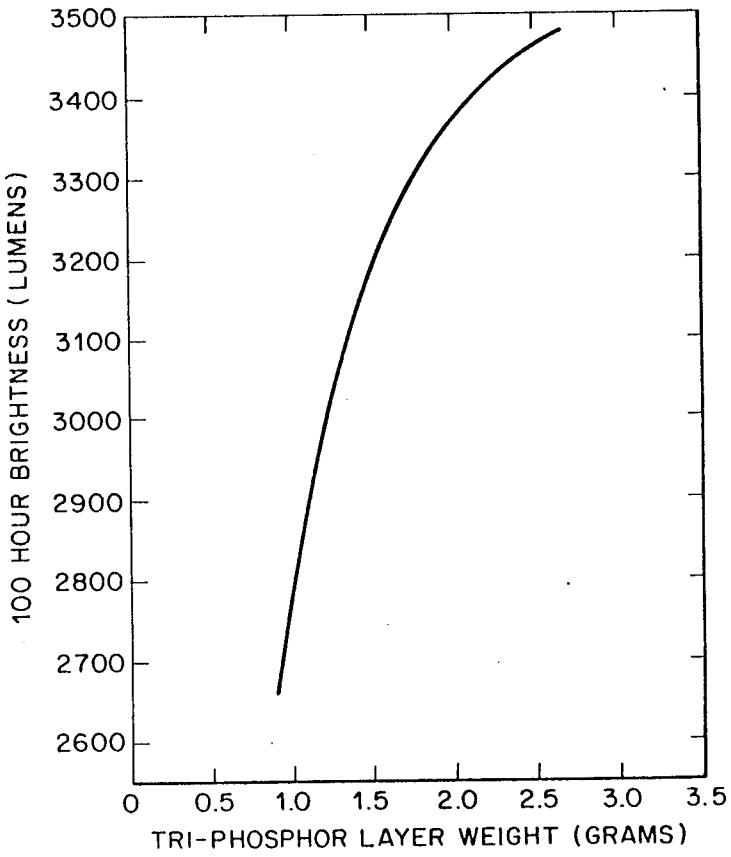
FIG. 3 graphically represents lumen output as a function of the triphosphor layer weight after 100 hours of operation for a lamp in accordance with the present invention which includes a fine particle-size silica layer with a weight of about 2 grams.

A third lamp test series involved a second-coat 3K° triphosphor weight series. The 3K° triphosphor coating weight was varied of a range from 0.91 g to 2.37 g. (The corrected 3K° triphosphor blend formulation was the 3K° triphosphor used in the third lamp series.) The fine particle-size silica layer of each lamp had a weight approximately 2 grams. Aerosil® OX-50 was used as the fine particle-size silica in the lamps of this third lamp test series. The results of this lamp series are tabulated in Table 3. As expected, lower brightness (lower lumens) was obtained at lower triphosphor weights. A 61.6% reduction in triphosphor weight, from 2.37 g to 0.91 g, results in a 22.7% reduction in brightness. However, high CRI's, around 84.0, were obtained, regardless of the triphosphor weight. The 100 hour lumen data for the lamps described in Table 3 is graphically represented in FIG. 3.

The silica coating in these tests clearly show that an 83.0–84.0 CRI 2900° K. lamp is obtained using a fine particle-size silica first coat and 3K° triphosphor second coat.

The silica used in the above-described experiments and tests was Aerosil® OX-50 obtained from DeGussa, Inc. Aerosil® OX-50 is a fluffy white powder and has a BET surface area of $50 \pm 15$ $m^2/g$. The average primary particle size of OX-50 is 40 nm. Aerosil® OX-50 contains greater than 99.8 percent $SiO_2$, less than 0.08 % $Al_2O_3$, less than 0.01% $Fe_2O_3$, less than 0.03 $TiO_2$, less than 0.01% HCl, and less than 0.1% sieve residue. (OX-50 has a tamped density of approximately 130 g/l).

TABLE 2

FINE PARTICLE-SIZE SILICA WEIGHT SERIES

| Lamp Description | First Coat Silica Wt.(g) | Second Coat Tri-Phosphor Wt.(g) | COLOR X | COLOR Y | COLOR CRI | BRIGHTNESS (HRS) 0 | 100 | 0-100 % M | 500 | 100-500 % M | 1000 | 100-1000 % M | 2000 | 100-2000 % M | 3000 | 100-3000 % M | 5000 | 100-5000 % M |
|---|---|---|---|---|---|---|---|---|---|---|---|---|---|---|---|---|---|---|
| C | 3.1 | 1.62 | .447 | .411 | 78.9 | 3362 | 3295 | 98.0 | 3252 | 98.7 | 3176 | 96.8 | 3124 | 94.8 | 3100 | 94.1 | 3042 | 92.3 |
| D | 3.38 | 1.78 | .459 | .408 | 84.0 | 3443 | 3294 | 95.7 | 3211 | 97.5 | 3167 | 96.1 | 3091 | 93.8 | 3043 | 92.4 | 3010 | 91.4 |
| E | 1.26 | 1.65 | .458 | .410 | 83.9 | 3305 | 3192 | 96.6 | 3158 | 98.9 | 3110 | 97.4 | 3082 | 96.6 | 3048 | 95.5 | 3036 | 95.1 |
| F | 0.98 | 1.60 | .457 | .408 | 83.7 | 3264 | 3145 | 96.4 | 3099 | 98.5 | 3087 | 98.2 | 3065 | 97.5 | 3020 | 96.0 | 3038 | 96.6 |

TABLE 3

TRIPHOSPHOR WEIGHT SERIES

| Lamp Description | First Coat Silica Wt.(g) | Second Coat Tri-Phosphor Wt.(g) | COLOR X | COLOR Y | COLOR CRI | BRIGHTNESS (HRS) 0 | 100 | 0–100 % M | 500 | 100–500 % M | 1000 | 100–1000 % M | 2000 | 100–2000 % M | 3000 | 100–3000 % M | 5000 | 100–5000 % M |
|---|---|---|---|---|---|---|---|---|---|---|---|---|---|---|---|---|---|---|
| G | 1.95 | 2.37 | .454 | .417 | 84.1 | 3554 | 3443 | 96.9 | 3368 | 97.8 | 3336 | 96.9 | 3268 | 94.9 | 3252 | 94.5 | 3177 | 92.3 |
| H | 1.92 | 1.68 | .459 | .413 | 84.0 | 3428 | 3267 | 95.3 | 3208 | 98.2 | 3155 | 96.6 | 3086 | 94.5 | 3056 | 93.5 | 2985 | 91.4 |
| I | 2.21 | 1.40 | .460 | .410 | 83.9 | 3329 | 3126 | 93.9 | 3032 | 97.0 | 2989 | 95.6 | 2927 | 93.6 | 2897 | 92.7 | 2846 | 91.0 |
| J | 2.02 | 1.19 | .458 | .410 | 83.7 | 3129 | 2952 | 94.4 | 2859 | 96.8 | 2799 | 94.8 | 2729 | 92.4 | 2729 | 92.4 | 2606 | 88.3 |
| K | 2.02 | 0.91 | .454 | .409 | 83.6 | 2908 | 2662 | 91.5 | 2542 | 95.5 | 2475 | 93.0 | 2384 | 89.6 | 2312 | 86.9 | 2215 | 83.2 |

While the foregoing lamp tests illustrate the advantages of the present invention when the fine particle-size silica layer comprises silicon dioxide particles having an average primary particle size of 40 nanometers, it is believed that CRI improvements of comparable magnitude ill be obtained with silica layers comprising silicon dioxide particles having an average primary particle size from about 16 nm to about 40 nm.

While there have been shown and described what are considered preferred embodiments of the present invention, it will be apparent to those skilled in the art that various changes and modifications may be made therein without departing from the invention as defined by the appended claims.

What is claimed is:

1. A fluorescent lamp comprising a glass lamp envelope having an inner surface; a pair of electrodes sealed in the envelope; a fill including an inert gas and mercury disposed within the envelope; a fine particle-size silica layer disposed on the inner surface of the lamp envelope, the silica layer containing greater than 0.7 $mg/cm^2$ of the fine particle-size silica; and a coating of phosphor having a CRI disposed over the silica layer, the fluorescent lamp having a CRI substantially equal to the CRI of the phosphor coating.

2. A fluorescent lamp in accordance with claim 1 wherein said phosphor coating consists essentially of a triphosphor blend.

3. A fluorescent lamp in accordance with claim 2 wherein said triphosphor blend comprises about 64 weight percent europium activated yttria, about 34 weight percent cerium terbium magnesium aluminate, and about 2 weight percent europium activated barium magnesium aluminate.

4. A fluorescent lamp in accordance with claim 1 wherein said phosphor coating contains greater than or equal to about 0.35 and less than about 3.75 $mg/cm^2$ triphosphor blend.

5. A fluorescent lamp in accordance with claim 1 wherein said silica layer contains from about 1.7 to about 3.5 $mg/cm^2$ fine particle-size silica.

* * * * *